US006105817A

United States Patent [19]

Ponton

[11] Patent Number: 6,105,817

[45] Date of Patent: Aug. 22, 2000

[54] CAP FOR A PACKAGING DEVICE

[75] Inventor: Thierry Ponton, Charenton le Pont, France

[73] Assignee: L'Oréal S.A., Paris, France

[21] Appl. No.: 09/146,039

[22] Filed: Sep. 2, 1998

[30] Foreign Application Priority Data

Sep. 3, 1997 [FR] France ..... 97 10961

[51] Int. Cl.[7] ..... B65D 41/16

[52] U.S. Cl. ..... 220/784; 220/212

[58] Field of Search ..... 215/216, 224, 215/225, 228, 317, 321; 220/212, 780, 784

[56] References Cited

U.S. PATENT DOCUMENTS

| | | | |
|---|---|---|---|
| 3,773,227 | 11/1973 | Laing et al. . | |
| 4,230,230 | 10/1980 | Mumford | 220/784 X |
| 4,315,576 | 2/1982 | Murphy et al. | 220/282 |
| 5,303,835 | 4/1994 | Haber et al. | 215/247 |
| 5,337,912 | 8/1994 | Jochem | 220/306 |
| 5,829,591 | 11/1998 | Lyons | 220/784 X |

FOREIGN PATENT DOCUMENTS

| | | |
|---|---|---|
| 0 606 935 | 7/1994 | European Pat. Off. . |
| 2 394 464 | 1/1979 | France . |
| 2 908 111 | 9/1980 | Germany . |
| 3 148 663 | 7/1983 | Germany . |

*Primary Examiner*—Stephen K. Cronin
*Attorney, Agent, or Firm*—Finnegan, Henderson, Farabow, Garrett & Dunner, L.L.P.

[57] ABSTRACT

A cap for detachable mounting onto a product container can be adjusted to meet varying tightness requirements. The cap includes deformable tabs with catches whose flexibility can be modified by selectively positioning an adjacent ring so that a varying portion of the ring surface cooperates with the tabs, thereby influencing the firmness of the tabs. Accordingly, the axial force necessary for the catches to engage a recess on the container can be modified as desired.

21 Claims, 4 Drawing Sheets

CAP FOR A PACKAGING DEVICE

BACKGROUND OF THE INVENTION

The present invention relates to an element of the type comprising a removable cap intended to surmount a packaging device. The invention is especially suitable for caps used to cover packaging units such as are used in the field of cosmetics, for example, perfumes, body deodorants, hair lacquers, and sprays, in the field of pharmacy, or in the field of household products.

In the field of cosmetics, and in particular in the field of aerosols or other spray dispensing devices, the container is covered by a removable cap, conventionally mounted by a catch engagement. For this purpose, the upper portion of the container has a throat or groove intended to receive a ring, or a plurality of catches, arranged on the internal surface of the cap in the vicinity of its free edge. When the cap is being mounted on the container, axial pressure exerted on the cap produces an elastic deformation of the walls of the cap carrying the catch engagement ring or catches, which deform radially outwardly to cross the edge adjacent to the throat or groove. After the edge has been crossed by the catches, they are held in the bottom of the groove by a resilient restoring force that holds the cap in position on the container. Alternatively, the throat or groove may be replaced by a bead projecting on the external surface of the container.

When the cap is made by molding it may be desirable, in particular for reasons of manufacturing costs, for the cap to be removable from the mold by pulling it out. Unfortunately, such a pulling out action causes damage to the ring or catches, consequently affecting their ability to hold or tighten. This problem becomes pronounced in view of the fact that the firmness between the cap and the container varies considerably from one container to another. Thus, for certain containers, the attachment will be distinctly insufficient.

Moreover, for certain products such as perfumes or body deodorants, there generally exists one product line for women and another product line for men. For these products, the tightening of the cap on the container must be stronger for the product line for men than for the product line for women. Conventionally, this is achieved by using two different molds, a first mold for the packaging unit for men, and a second mold for the packaging unit for women. This multiplication of the equipment accordingly increases the cost price of the packaging unit, and of the cap, in particular.

SUMMARY OF THE INVENTION

Thus, one of the objects of the invention is to provide a cap intended to be mounted on a container by catch engagement with adjustable firmness, and whose firmness of the attachment on the container can be adjusted according to need.

Another object of the invention is to provide a cap that can be made by the same industrial tool, and offering different attachment characteristics.

Other objects will become apparent in detail in the description that follows.

In accordance with the invention, these objects are obtained by a cap for detachably covering a container adapted to receive said cap, said cap comprising at least one elastically deformable holder adapted to hold said cap on said container, wherein the force necessary for causing said holder to hold said cap on said container is adjustable.

Preferably, these objects are attained by creating a cap for detachably covering a container having a catch engagement edge intended to be passed by at least one catch carried by at least one elastically deformable part of the cap, in response to an axial force exerted on the cap, wherein the cap comprises means for adjusting the elasticity of at least one of the elastically deformable parts so as to modify the axial force necessary for the catches to pass over the engagement edge during opening and closing.

Within the meaning of the present invention, the catch engagement edge is understood to mean either (i) the edge of a hollow portion (a throat, groove, or recess) in which the catches come to be accommodated during their mounting, or (ii) a projecting bead on the surface of the container behind which the catches come to be accommodated. In the case of a valve, the recess may be formed by the part situated beneath the crimping collar of the valve.

Similarly, within the meaning of the present invention, the term "cap" refers in particular to any closing means (a cover cap, stopper, cap, capsule, lid, etc.) or other accessory (e.g., an applicator) capable of detachably surmounting a container of any form (e.g., a tube, flask, pot, bottle, box, or can).

Thus, there is created a cap suitable for being mounted by catch engagement on a container. For the same cap it is possible to choose varying degrees of tightening-from strong to medium to weak. The choice of the tightening is effected during or after mounting of the cap. For a given adjustment, the hold of the cap is identical from one cap to another.

The same cap can be used for a product line for women or a product line for men. It suffices merely to modify the adjustment of the tightening of the cap.

Preferably, the means for adjusting the elasticity of the elastically deformable parts comprise an element that is mounted on the cap and whose angular or axial position relative to the cap determines the elasticity of the elastically deformable parts.

According to one embodiment, the cap comprises:

a) an internal wall carrying at least one elastically deformable, axially orientated tab, having a first end joined to the internal wall, and on the opposite side to the first end a free end carrying a catch;

b) an external wall at least partially surrounding the internal wall; and c) a ring disposed in an annular space formed between the internal wall and the external wall, said ring having an edge whose axial position relative to the elastically deformable tabs is adjustable so as to modify the mean axial height of the free tab portion situated between the free end of the tab and the edge of the ring, and thus to modify the elasticity of the tabs.

In a preferred embodiment, the cap comprises three tabs regularly disposed over the internal wall.

According to an embodiment, the edge forms at least one ramp, so that when the angular position of the ring relative to the tab brings the ramp opposite one elastically deformable tab, the mean axial height of the free tab portion situated between the free end and the edge varies, thus modifying the elasticity of the tab, means being provided for immobilizing the ring in a given angular position inside the annular space. Preferably, the edge forms as many ramps as there are elastically deformable tabs.

By modifying the angular position of the ring in the annular space, one progressively modifies the surface of the ring opposite the upper portion of the flexible tab, which consequently modifies the mean axial height of the free portion of the tab (i.e., the lower portion). The tab is thus more flexible or less flexible and is therefore deformed more easily or less easily to allow the catches to pass over the catch engagement edge. The force to be exerted for mounting or removing the cap will therefore be greater or smaller.

The ring may have on the side opposite the first edge a substantially straight edge situated proximate the first end of the tabs when the ring is in its mounted position on the cap.

Preferably, the means for fixing the ring in a given angular position may comprise an axial rib provided on an internal surface of the external wall and capable of coming into engagement with a groove chosen from a plurality of axial grooves disposed on an external surface of the ring. Furthermore, the ring may be axially held in position in the annular space by catch engagement or a self-tightening mounting.

In one embodiment, the first edge of the ring, at least over a portion, is situated opposite a tab, which is elastically deformable, substantially straight, and perpendicular to the axis of the cap, the mean axial height of the free tab portion situated between the free end and the edge being adjusted by modifying the axial position of the ring in the annular space, and means being provided for axially immobilizing the ring in the annular space. This arrangement is advantageous in that it makes it possible to have the axial height of the flexible portion of the tab uniform over the whole width of the tab. Moreover, it may be used for a cap with a non-circular cross-section.

The cap may be axially fixed in position by catch engagement, by self-tightening, or by any other appropriate means. In a preferred embodiment, the cap is covered by an outer covering.

The internal wall and the external wall may form a single part obtained by molding a thermoplastic material, the external wall having opposite each elastically deformable tab a clearance so as to allow the elastically deformable tabs to be taken out of the mold. The ring may be obtained by molding a thermoplastic material chosen from polypropylenes or high density polyethylenes.

A second aspect of the invention provides a packaging and dispensing unit that comprises a container containing a product, e.g., cosmetic, pharmaceutical, or household, and a cap according to the first aspect surmounting the container.

BRIEF DESCRIPTION OF THE DRAWINGS

Apart from the arrangements set out above, the invention comprises several other features that will be explained below with regard to non-restrictive examples of the embodiments, described with reference to the attached drawings.

DETAILED DESCRIPTION OF PREFERRED EMBODIMENTS

Figure 1A:
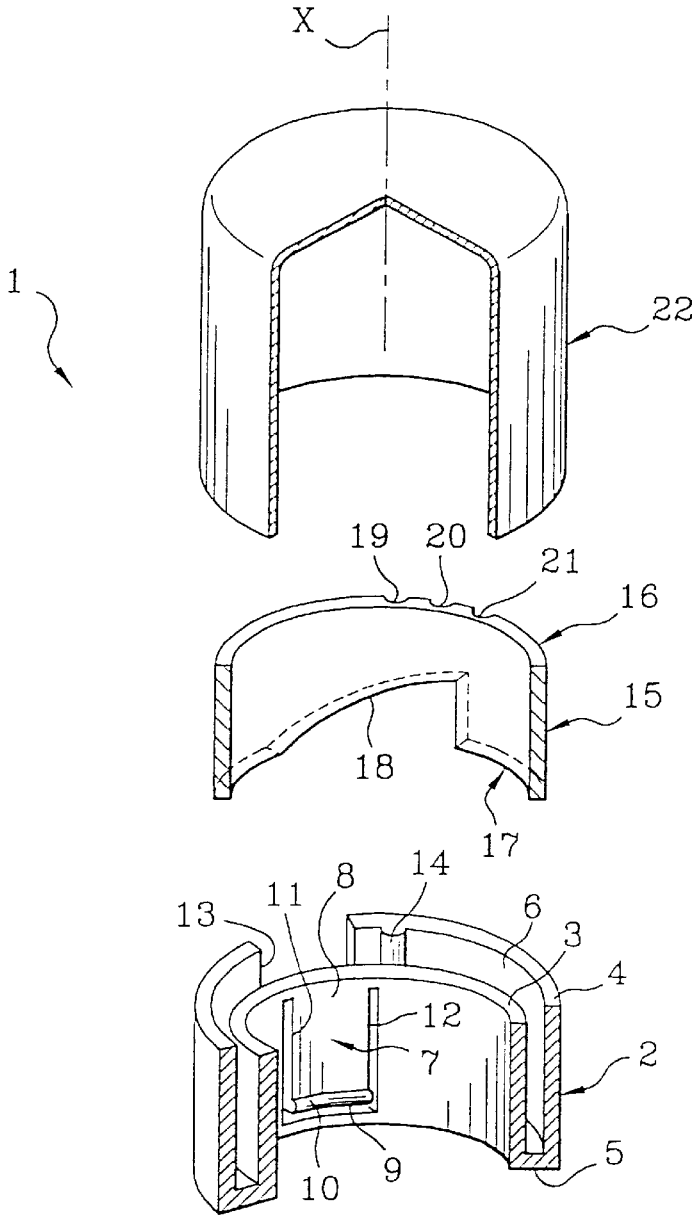
FIG. 1A shows a partial exploded view, in perspective, of a preferred embodiment of the cap in accordance with the invention.

FIG. 1A, to which reference will now be made, shows an exploded view of an embodiment of a cap 1 in accordance with the invention. The cap 1 includes a main body 2 preferably made of a molded plastic material such as a polypropylene, a high density polyethylene, or polyethylene terephthalate. The body 2 has an internal wall 3 and an external wall 4 joined in the vicinity of one of their ends by an annular transverse wall 5. The other end of the internal and external walls 3, 4 is free, so that the internal and external walls 3, 4 define between them an annular space 6. In the embodiment illustrated, the internal wall 3 has a slightly lower axial height than the axial height of the external wall 4.

The internal wall 3 has three elastically deformable tabs 7, orientated axially and radially interspaced at 120°. Each one of the tabs 7 has a free end 9 in the vicinity of the annular wall 5 and disposed on the inner surface of the free end is a catch 10. The end 8 on the side opposite the free end 9 is joined to the internal wall 3. The tab 7 is also delimited by two side edges 11, 12 separated from the internal wall 3 by a thin slot extending substantially over the whole height of the tab 7. Opposite each one of the tabs 7, the external wall 4 has a cutout 13 that substantially matches the surface of the tabs 7, so as to allow the tabs 7 to be removed from a mold. The inner surface of the external wall 4 has an axial bead (or rib) 14 whose purpose will be described in greater detail below.

The cap 1 illustrated in FIG. 1A also comprises a ring 15 with a thickness slightly smaller than the width of the annular space 6 so as to be capable of insertion in the annular space 6. The maximum axial height of the ring 15 is substantially equal to the axial height of the internal wall 3. The ring 15 is delimited by a substantially straight upper edge 16 along the top and a variable edge 17 along the bottom. The variable edge 17 is intended to be proximate the transverse annular wall 5 when the ring 15 is mounted in the annular space 6. The variable edge 17 has three regularly interspaced portions that form ramps 18. As becomes apparent in greater detail in FIG. 2A, the edge 17 is saw-tooth shaped. The external surface of the ring 15 has three axial grooves 19, 20, 21, where one is intended, according to the angular position of the ring 15 in the annular space 6, to come into engagement with the rib 14 of the external wall 4 of the body 2, so as to immobilize the ring 15 angularly inside the annular space 6 when the adjustment of the elasticity of the tab has been effected.

Figure 1B:
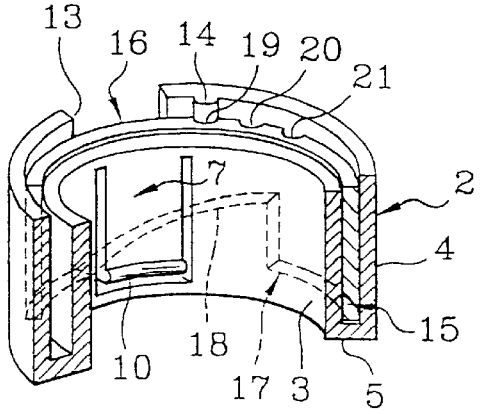
FIG. 1B shows a partial, perspective view of the cap of FIG. 1A in the mounted position.
Figure 2B:
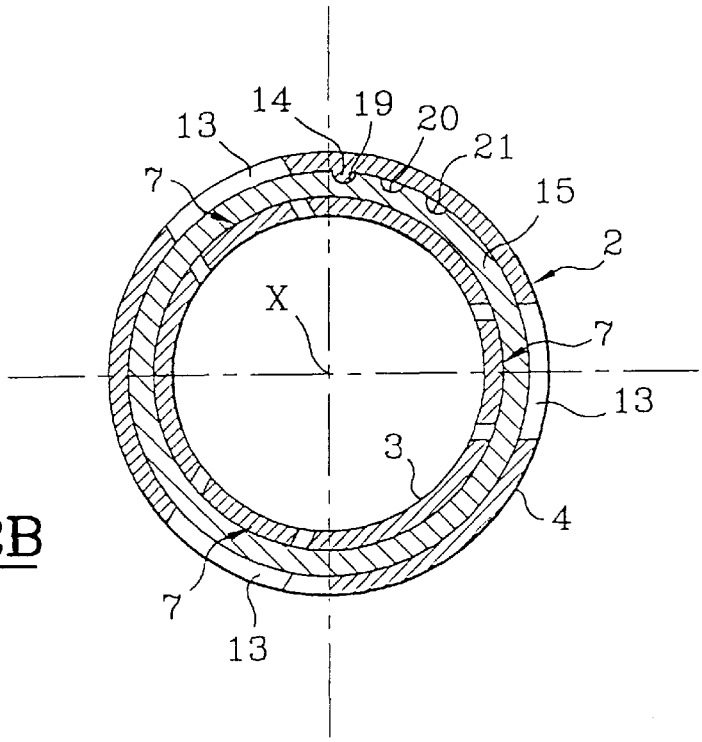
FIG. 2B schematically shows the mechanism for regulating the elasticity of the tabs of the cap of FIG. 1A.
Figure 4:
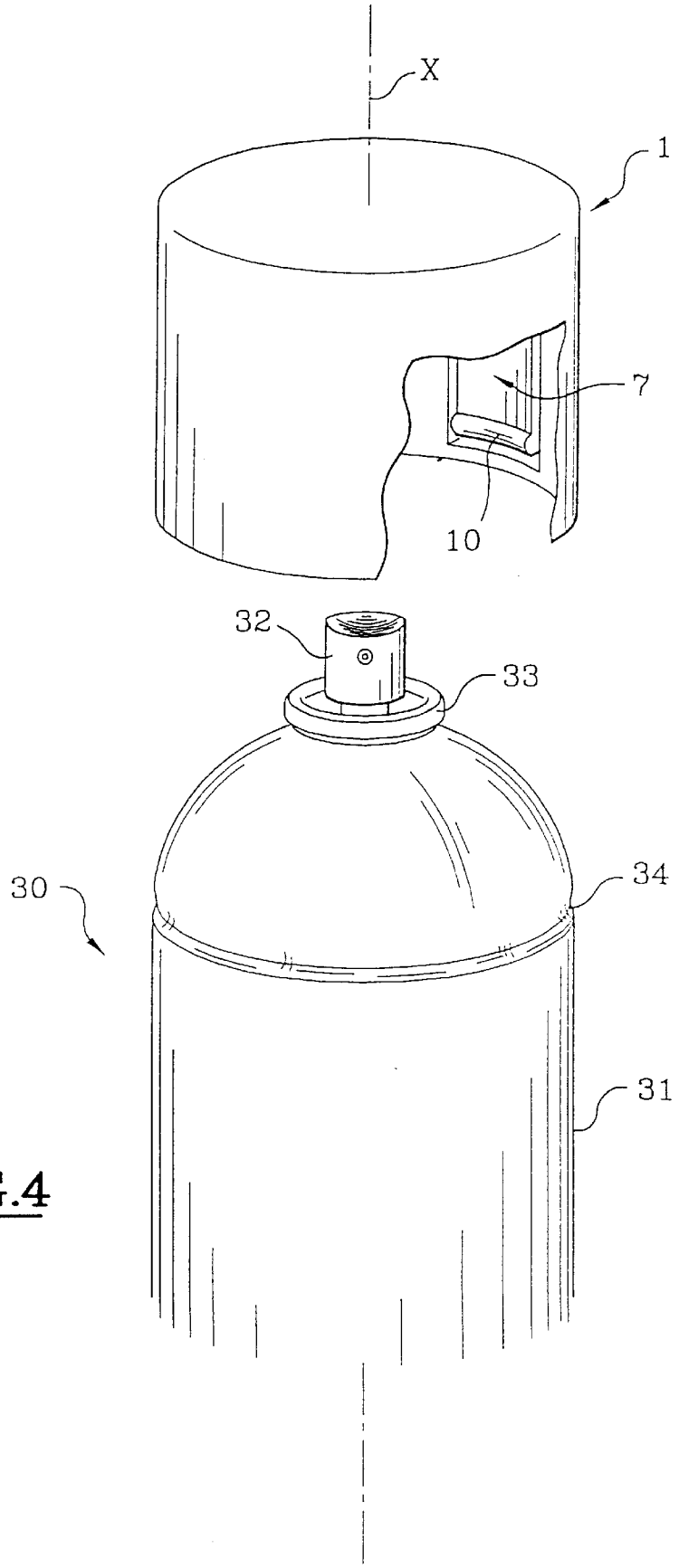
FIG. 4 is a perspective view of a packaging and dispensing unit using a cap in accordance with the present invention.

Thus, during the mounting of the cap 1, the ring 15 is inserted into the annular space 6 of the main body 2, as shown in FIGS. 1B and 2B. Referring again to FIG. 2A, when the axial rib 14 of the body 2 is disposed in the groove 19, the ring 15 faces virtually the whole of the surface of the tabs 7 (position A). The mean axial height of the free portion of the tabs 7 (indicated by the distance between the black dot and the free end 9 of the tab 7) is substantially equal to zero. Because of this, the elasticity of the tab 7 is low. With reference to FIG. 4, which shows a packaging unit 30 with a catch engagement edge 34 adapted to accept the tabs 7, the axial force to be exerted to cause the catches 10 to cross and enter the catch engagement edge 34 is high.

When the axial rib 14 of the body 2 is disposed in the groove 20, causing the ring 15 to rotate in the annular space 6, the ring 15 is opposite approximately half the surface of the tab 7 (position B). The mean axial height of the free part of the tabs 7 corresponds substantially to half the height of the tab 7. Because of this, the elasticity of the tab 7 is medium. The axial force to be exerted for causing the catches 10 to cross the catch engagement edge 34 is medium.

When the axial rib 14 of the body 2 is disposed in the groove 21, the ring 15 is opposite approximately one third of the surface of the tab 7 (position C). The mean axial height of the free portion of the tabs 7 corresponds substantially to two thirds the height of the tab. Because of this, the elasticity of the tab is high. The axial force to be exerted for the catch engagement edge 34 to be crossed by the catches 10 is low.

Means, not shown, may be provided for axially immobilizing the ring 15 in the annular space 6. By way of example, there may be a groove and rib arrangement (not shown). Alternatively, the ring 15 can be force-fitted in the annular space 6.

Once the tightening has been adjusted, the cap 1 is covered with a metal or plastic outer shell 22. The outer shell 22 may be mounted by tightening, bonding, catch engagement, welding, or other suitable means.

Figure 3:
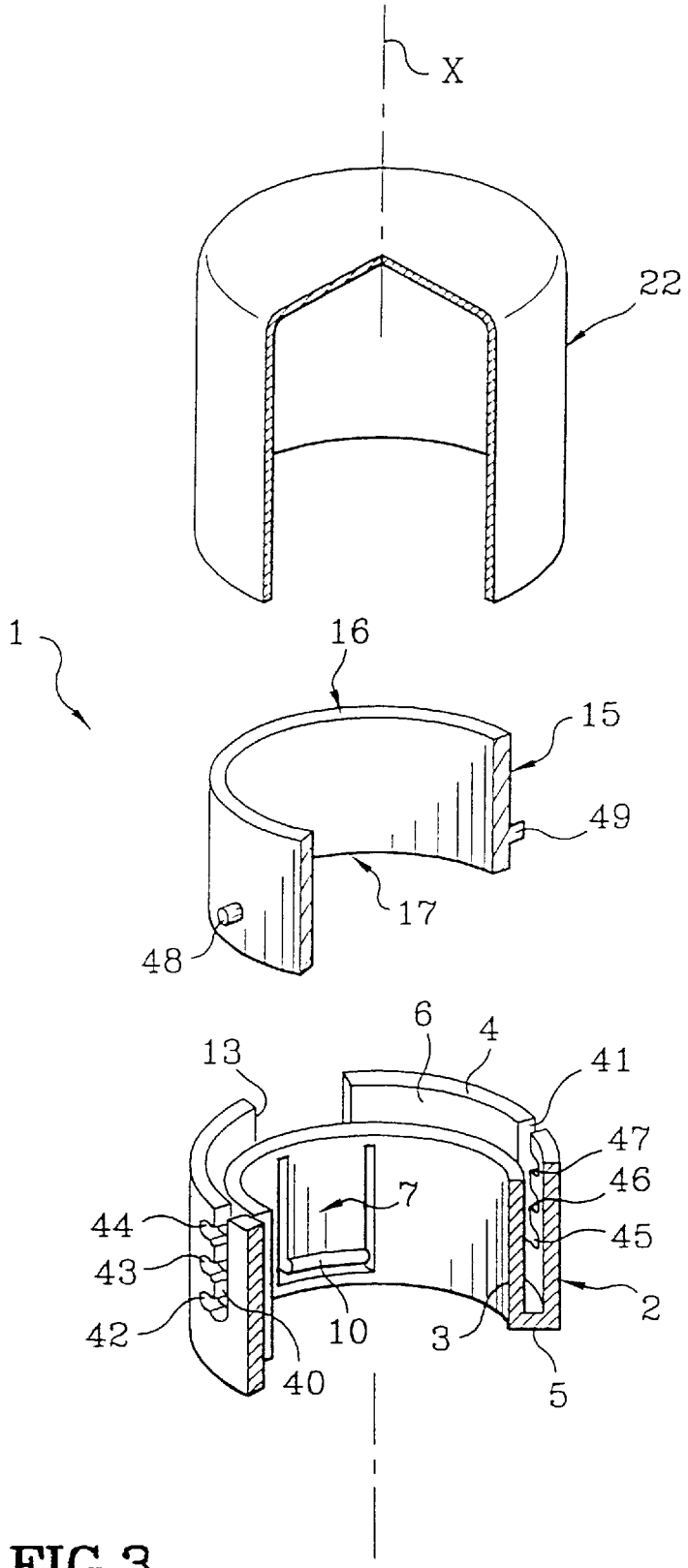
FIG. 3 illustrates another embodiment of the present invention in a partial, exploded view, in perspective.

In the embodiment shown in FIG. 3, the bottom edge 17 of the ring 15 is parallel to the upper edge 16, that is to say, substantially perpendicular to the axis X of the cap 1. According to this variant, the mean axial height of the free tab portions, and hence the elasticity of the tabs 7, is adjusted no longer by modifying the angular position of the ring 15 relative to the tabs 7, but by modifying the axial position of the ring 15, namely, by lowering the ring 15 to a greater or lesser extent into the annular space 6. The axial hold of the ring 15 in a given position is ensured either by tightening or, as shown in FIG. 3, by making, at two diametrically opposite points of the external wall 4, slots 40, 41 parallel to the axis X, wherein one of the edges of each slot 40, 41 features a plurality of recesses 42, 43, 44, 45, 46, 47 capable of receiving corresponding studs 48, 49, by catch engagement, also provided at two diametrically opposite points on the outer surface of the ring 15.

Figure 2A:
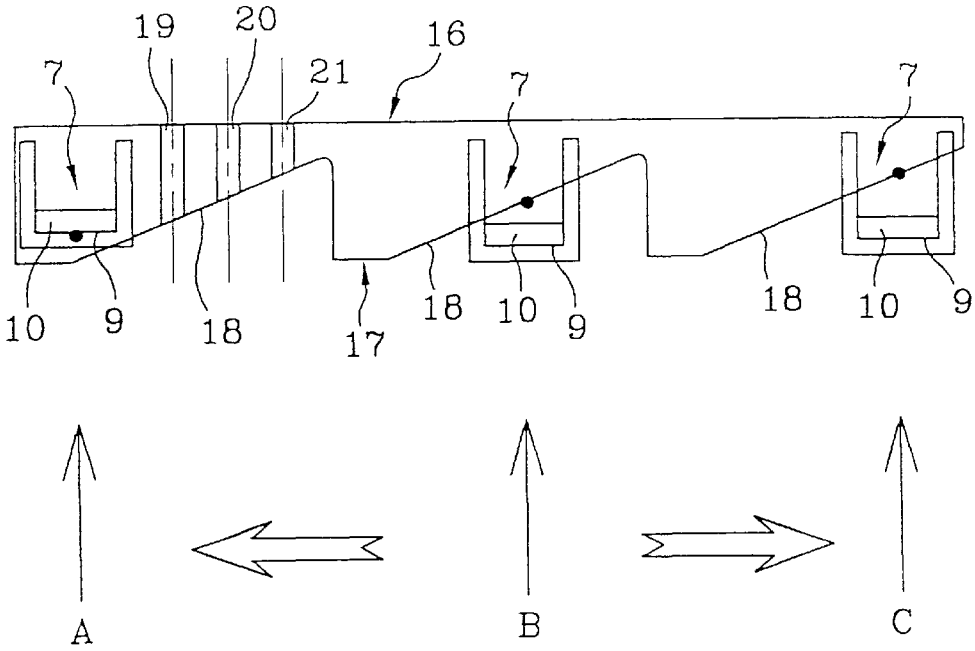
FIG. 2A shows a sectioned plan view of the cap of FIG. 1A.

Thus, during mounting, if the studs 48, 49 are disposed in the lower recesses 42, 45, the ring 15 is opposite virtually the whole of the surface of the tabs 7 (akin to position A in FIG. 2A). The axial height of the free portion of the tabs 7 is substantially equal to zero. Because of this, the elasticity of the tab is low. The axial force to be exerted to cause the catches 10 to cross the catch engagement edge 34 is high.

In the same way, if the studs 48, 49 are disposed in the intermediate recesses 43, 46, the ring 15 is opposite approximately half the surface of the tabs 7 (akin to position B in FIG. 2A). The mean axial height of the free portion of the tabs 7 corresponds substantially to half the height of the tab 7. Because of this, the elasticity of the tab 7 is medium. The axial force to be exerted to cause the catches 10 to cross the catch engagement edge 34 is medium.

Finally, if the studs 48, 49 are disposed in the upper recesses 44, 47, the ring 15 is opposite approximately a third of the surface of the tabs 7 (akin to position C in FIG. 2A). The mean axial height of the free portion of the tabs 7 corresponds substantially to two thirds of the height of the tab 7. Because of this, the elasticity of the tab 7 is high. The axial force to be exerted to cause the catches 10 to cross the catch engagement edge 34 is low.

FIG. 4 illustrates a packaging unit 30 formed by a reservoir in the form of a can 31. The reservoir is surmounted by a valve which is itself surmounted by a push button 32. The valve is crimped by means of a crimping collar 33. In the vicinity of the upper end of the straight portion of the can 31, there is formed a catch engagement edge 34 intended to receive the catches 10 carried by the cap 1, such as discussed with reference to the preceding figures. Alternatively, the catch engagement edge may be constituted by a recess formed under the crimping collar 33.

In the preceding detailed description, reference has been made to preferred modes of embodiment of the invention. It is obvious that variants can be introduced into them without departing from the spirit of the invention, such as claimed below.

I claim:

1. A cap for detachably covering a container adapted to receive said cap, said cap comprising:

at least one elastically deformable holder adapted to hold said cap on said container; and an adjustment portion, wherein a force necessary for causing said holder to hold said cap on said container is adjustable by adjusting the adjustment portion prior to placing said cap on said container.

2. A cap for detachably covering a container having a catch engagement edge, said cap comprising:

at least one elastically deformable tab;

a catch formed on the deformable tab; and an adjustment element, wherein a force necessary for causing said catch to engage the catch engagement edge is adjustable by adjusting the adjustment element to a particular position prior to placing said cap on said container.

3. A cap according to claim 2, wherein the force for causing the catch to engage the engagement edge is made adjustable by the adjustment element cooperating with the at least one elastically deformable tab, and wherein the adjustment element can be selectively positioned relative to the at least one deformable tab to adjust the force necessary for said catch to engage the catch engagement edge of the container.

4. A cap according to claim 3, wherein the adjustment element comprises a ring mounted on the cap, and wherein at least one of an angular and an axial position of the ring relative to the cap determines the elasticity of the elastically deformable tabs.

5. A cap according to claim 4, wherein the angular position of the ring relative to the cap determines the elasticity of the elastically deformable tabs.

6. A cap according to claim 4, further comprising a main body having an internal wall, wherein the at least one deformable tab is axially disposed on said internal wall, the deformable tab having a first end joined to the internal wall and an opposed second end that is free from the internal wall, wherein the catch is disposed on the second end;

an external wall at least partially surrounding and concentric to the internal wall;

and an annular wall connecting the internal and external walls at one of their ends, said annular wall, internal wall, and external wall defining an annular space, wherein the ring is disposed in said annular space, the ring having a first edge shaped such that the axial position of at least a portion thereof, opposite at least one elastically deformable tab, is adjustable so as to modify the mean axial height of the free tab portion situated between the free end of the tab and the first edge of the ring, thereby allowing the elasticity of the tab to be modified.

7. A cap according to claim 6, wherein the ring is axially held in position in the annular space by a catch engagement, a groove and rib arrangement, or a self-tightening mounting.

8. A cap according to claim 6, wherein there are three elastically deformable tabs regularly disposed along the internal wall.

9. A cap according claim 6, wherein the ring further comprises a second edge opposed to the first edge, said second edge being substantially straight and situated substantially opposite the first end of the tabs when the ring is in its mounted position on the cap.

10. A cap according to claim 6, further comprising an outer shell that covers the main body and ring.

11. A cap according to claim 6, wherein the internal and external walls of the main body form a single part obtained by molding a thermoplastic material, the external wall having opposite each deformable tab a clearance so as to allow the deformable tabs to be removed from the mold.

12. A cap according to claim 6, wherein the ring is obtained by molding a thermoplastic material chosen from polypropylenes or high density polyethylenes.

13. A cap according to claim 6 wherein the first edge of the ring forms at least one ramp, so that when the angular position of the ring relative to the tab is such that said ramp is situated opposite one elastically deformable tab, the mean axial height of the free tab portion situated between the free end of the tab and the first edge of the ring varies, depending on the position selected, thereby modifying the elasticity of the tab.

14. A cap according to claim 13, further comprising an axial rib provided on the inner surface of the main body external wall and a plurality of axial grooves disposed on the outer surface of the ring, each of said grooves adapted to mate with said rib, wherein the angular position of the ring is set by engaging the axial rib with one of the grooves, as selected.

15. A cap according to claim 6, wherein at least a portion of the first edge of the ring is situated opposite the deformable tab, said first edge being substantially straight and perpendicular to the cap axis, wherein further the mean axial height of the free tab portion situated between the free end of the tab and the first edge of the ring is adjustable by modifying the axial position of the ring.

16. A cap according to claim 15, further comprising a plurality of slots disposed on the main body external wall and studs disposed on the outer wall of the ring, said slots adapted to receive and hold said studs, whereby the mean axial height of the free tab portion situated between the free end of the tab and the first edge of the ring is adjustable by modifying the axial position of the ring by placing the studs in selected slots.

17. A packaging and dispensing unit comprising:

a container containing a product; and a cap surmounting said container, said cap comprising, at least one elastically deformable tab, a catch formed on the deformable tab, and an adjustment element, wherein the force necessary for causing said catch to engage the catch engagement edge is adjustable by adjusting the adjustment element to a particular position prior to placing said cap on said container.

18. A packaging and dispensing unit according to claim 17, wherein the force for causing the catch to engage the engagement edge is made adjustable by the adjustment element cooperating with the at least one elastically deformable tab, and wherein the adjustment element can be selectively positioned relative to the deformable tab to adjust the force necessary for said catch to engage the catch engagement edge of the container.

19. A packaging and dispensing unit according to claim 18, wherein the product includes at least one of a cosmetic product, a pharmaceutical product, and a household product.

20. A cap for covering a container, said cap including a flexible holder and an adjustment part, said holder being configured to hold said cap on said container when said cap is placed on said container, wherein a holding force applied by said holder to said container can be varied by setting the adjustment part to one of a plurality of positions, the adjustment part being configured to be set to a particular position prior to being placed on said container and to remain in the particular position when being placed on said container.

21. A method of covering a container, the method comprising:

providing a cap and a container, said cap including at least one flexible member and an adjustment part, said member being configured to maintain said cap on said container when said cap is placed on said container, wherein a maintaining force applied by said member to said container can be varied by setting the adjustment part to one of a plurality of positions prior to placing said cap on said container;

setting the adjustment part to a particular position; and placing said cap on said container after the setting so that the adjustment part is in the particular position when said cap is placed on said container.

* * * * *